US005429092A

United States Patent [19]

Kamei

[11] Patent Number: 5,429,092

[45] Date of Patent: Jul. 4, 1995

[54] THROTTLE CONTROL SYSTEM

[75] Inventor: Sadaaki Kamei, Himeji, Japan

[73] Assignee: Mitsubishi Denki Kabushiki Kaisha, Tokyo, Japan

[21] Appl. No.: 201,358

[22] Filed: Feb. 24, 1994

[30] Foreign Application Priority Data

Feb. 25, 1993 [JP] Japan ..... 5-036391

[51] Int. Cl.[6] ..... F02D 11/10

[52] U.S. Cl. ..... 123/399; 123/198 D

[58] Field of Search ..... 123/198 D, 361, 399

[56] References Cited

U.S. PATENT DOCUMENTS 4,920,939 5/1990 Gale ..... 123/399
5,065,721 11/1991 Wiggins ..... 123/399
5,255,653 10/1993 Ironside et al. ..... 123/399

FOREIGN PATENT DOCUMENTS 3510173 2/1986 Germany .
4133571 4/1993 Germany .
141841 6/1991 Japan .
29862 5/1992 Japan .

*Primary Examiner*—Tony M. Argenbright
*Attorney, Agent, or Firm*—Sughrue, Mion, Zinn, Macpeak and Seas

[57] ABSTRACT

A throttle control system capable of ensuring and maintaining a minimum function of driving a motor vehicle by engine power with safety. A malfunction detection section detects a malfunction of at least one of first and second accelerator sensors and an accelerator switch on the basis of first and second accelerator operation amount signals and an accelerator switch output signal. A throttle opening control section forms a throttle control signal according to the first accelerator operation amount signal when the accelerator sensors are operating normally, and forms the throttle control signal on the basis of the accelerator output signal when a malfunction of the first or second accelerator sensor is detected.

8 Claims, 6 Drawing Sheets

THROTTLE CONTROL SYSTEM

BACKGROUND OF THE INVENTION

1. Field of the Invention:

This invention relates generally to throttle control systems for controlling the throttle opening by an electrical signal and, more particularly, to a throttle control system capable of maintaining a minimum function of operating with safety even if an accelerator sensor which determines a target throttle opening malfunctions.

2. Description of the Related Art:

In conventional throttle control systems for controlling a motor vehicle throttle valve by an electrical signal, the throttle opening of a motor vehicle is controlled on the basis of a signal representing the amount of accelerator operation from an accelerator sensor or the like and, therefore, there is a risk of a malfunction of the accelerator sensor for detecting the amount of accelerator pedal operation resulting in a serious vehicle accident. Various fail-safe techniques have therefore been proposed for the purpose of preventing uncontrollable speeding or the like of a motor vehicle when a malfunction of an accelerator sensor or the like occurs.

FIG. 5 is a block diagram of a motor vehicle throttle control system disclosed in Japanese Patent Laid-Open Publication No. 3-141841. In FIG. 5, a block 1 represents an accelerator pedal (hereinafter referred to simply as "accelerator"), and blocks 20 and 21 represent first and second accelerator sensors which detect the amount of depression (operation) of the accelerator 1 to output accelerator operation amount signals $\alpha$ 1 and $\alpha$ 2 corresponding to the amount of operation. An accelerator switch 22 outputs an on-off signal $\beta$ representing whether or not the accelerator 1 is depressed. The accelerator switch 22 is operated in response to a predetermined amount of operation (mentioned later) in the range of operation of the accelerator 1.

An engine revolution sensor 4 detects the number of revolution R of an engine 3. A throttle valve (hereinafter referred to simply as "throttle") 5 serves to control the intake air flow into the engine 3. A throttle actuator 6 drives the throttle 5 by an electrical signal. A throttle sensor 7 detects the actual opening $\theta$ of the throttle 5. A vehicle speed sensor 8 detects the speed V of the motor vehicle.

A control unit (control means) 10 formed of a microcomputer receives the accelerator operation amount signals $\alpha$ 1 and $\alpha$ 2, the output signal $\beta$, a signal representing the throttle opening $\theta$, the vehicle speed V and the engine revolutions R, and forms a throttle control signal $\gamma$ for the throttle actuator 6 according to a target opening of the throttle 5.

The control unit 10 has a throttle opening control section (not shown) for calculating a target opening of the throttle 5 on the basis of the accelerator operation amount signals $\alpha_1$ and $\alpha_2$, the vehicle speed V and the engine revolutions R and for making the throttle opening $\theta$ coincide with the target opening, and a malfunction detection section (not shown) for detecting a malfunction of the accelerator sensor 20 or 21 on the basis of the accelerator operation amount signals $\alpha_1$ and $\alpha_2$ and the output signal $\beta$ from the accelerator switch 22.

FIGS. 6A to 6C are characteristic diagrams showing the accelerator operation amount signals $\alpha_1$ and $\alpha_2$ and the output signal $\beta$ from the acceleration switch 22 with respect to the actual accelerator opening. FIG. 6A shows a characteristic of the accelerator operation amount signal $\alpha_1$ from the accelerator sensor 20, FIG. 6B shows a characteristic of the accelerator operation amount signal $\alpha_2$ from the accelerator sensor 21, and FIG. 6C shows a characteristic of the output signal $\beta$ from the accelerator switch 22.

In FIG. 6C, a value A on the abscissa represents a predetermined accelerator opening corresponding to a predetermined operation amount $\alpha_0$ at which the accelerator switch 22 is turned on or off.

An example of a change in the signal shown in FIG. 6B indicates that a malfunction occurs in the accelerator sensor 21 in the range between accelerator openings B1 and B2.

The operation of the conventional throttle control system shown in FIG. 5 will be described below with reference to FIGS. 6A to 6C.

First, when a driver depresses the accelerator 1, the accelerator operation amount signals $\alpha_1$ and $\alpha_2$ corresponding to the amount of depression of the accelerator 1 are generated from the first and second accelerator sensors 20 and 21. The accelerator switch 22 is turned on if the driver depresses the accelerator 1 to the predetermined opening A, or it is off if the driver has not yet depressed the accelerator 1 to the predetermined accelerator opening A.

The control unit 10 obtains the average of the two accelerator operation amount signals $\alpha_1$ and $\alpha_2$, and calculates a target value of the throttle opening, i.e., a target opening, on the basis of information including the accelerator operation amount average, the engine revolutions R and the vehicle speed V. The control unit 10 then forms throttle control signal $\gamma$ such that the throttle opening $\theta$ detected by the throttle sensor 7 will coincide with the target opening, and outputs the throttle control signal $\gamma$ to the throttle actuator 6.

At this time, the control unit 10 recognizes, from the throttle opening $\theta$, whether the throttle 5 has been actually opened to the target opening, and controls the opening $\theta$ of the throttle 5 so that the target opening is reached.

Thus, the intention of the driver is detected as the amount of depression of the accelerator 1 through the accelerator sensors 20 and 21, transmitted to the control means 10 and used to control the throttle 5 through the throttle actuator 6, thus controlling the output of the engine 3.

If an abnormality of one of the accelerator sensors 20 and 21 occurs, a large voltage difference is caused between the accelerator operation amount signals $\alpha_1$ and $\alpha_2$.

The following is an example of the control operation in a case where the accelerator sensor 20 malfunctions. If the control unit 10 determines that the accelerator operation amount signal $\alpha_1$ is greater than the predetermined value $\alpha_0$ when the accelerator switch 22 is OFF or that the accelerator operation amount signal $\alpha_1$ is smaller than the predetermined value $\alpha_0$ when the accelerator switch 22 is ON, the control unit 10 then determines that there is an abnormality, i.e., the accelerator sensor 20 is malfunctioning, and thereafter changes its operation from the normal control to a control using only the accelerator operation amount signal $\alpha_2$ from the accelerator sensor 21.

In such a case, i.e., in the case of a malfunction of one of the acceleration sensors 20 and 21, the other one functions to back up the malfunctioning sensor.

On the other hand, in the case of a malfunction of the accelerator switch 22, the malfunction is not detected and the ordinary throttle control based on the average of the accelerator operation amount signals $\alpha_1$ and $\alpha_2$ is continued, because the output signal $\beta$ from the accelerator switch 22 contributes only to the detection of malfunctions of the accelerator sensors 20 and 21 and does not relate directly to the throttle control.

In the above-described conventional method, however, malfunctions of the accelerator sensors 20 and 21 are not sufficiently considered and a malfunction cannot be detected under some condition.

For example, a case of a malfunction of the accelerator sensor 21, such as that shown in FIG. 6B, will be described below.

The output signal $\beta$ of the accelerator switch 22 is ON when the accelerator opening, which is the amount of depression of the accelerator 1, exceeds A %, and the output signal $\beta$ is OFF when the accelerator opening is smaller than this value. It is assumed here that a malfunction has occurred in the range of accelerator opening of B1 to B2% and the accelerator operation amount signal $\alpha_2$ is largely different from $\alpha_1$ and has a value $\alpha_2$=C [V].

The values A, B1 and B2 are in a relationship: A<B-1<B2%, and the accelerator switch 22 is in the on state in the accelerator opening range of B1 to B2. The accelerator sensor 20 is in the normal state, the accelerator operation amount signal $\alpha_1$ changes in the range of D1 to D2 [V] with respect to the accelerator opening range of B1 to B2.

In the case of such a malfunction of the accelerator sensor 21, a large difference is caused between the accelerator operation amount signals $\alpha_1$ and $\alpha_2$ in the accelerator opening range of B1 to B2. However, the control unit 10 cannot determine whether one of the accelerator sensors 20 and 21 malfunctions.

This is because, since the method of determining that one of two accelerator sensors malfunctions if it outputs an accelerator operation amount signal smaller than a predetermined value $\alpha_0$ is used, a malfunction as in a direction such that the output increases as in the case of the accelerator operation amount signal $\alpha_2$ (see FIG. 6B) cannot be determined if the output signal $\beta$ from the accelerator switch 22 is ON in the accelerator opening interval from B1 to B2%.

Also, when the accelerator switch 22 is off, both the accelerator sensors 20 and 21 output the accelerator operation amount signals $\alpha_1$ and $\alpha_2$ in the normal state and, therefore, it is also impossible of determine whether one of the accelerator sensors malfunctions.

Accordingly, the control unit 10 uses the average of the accelerator operation amount signals $\alpha_1$ and $\alpha_2$ as in the normal state and calculates a target throttle opening from the average of the value D1 to D2 of the accelerator operation amount signal $\alpha_1$ and the value C of the accelerator operation amount signal $\alpha$ 2 in the accelerator opening range of B1 to B2. The throttle 5 is thereby opened abruptly. Such a control failure may lead to excessive speeding of the vehicle in the worst case.

With respect to such a malfunction, processing of selecting the smaller one of the accelerator operation amount signals $\alpha_1$ and $\alpha_2$ may be performed to prevent abrupt opening of the throttle 5. In the case of using such processing, however, if a malfunction occurs as in a direction such that the accelerator operation amount signal $\alpha_1$ or $\alpha_2$ decreases, there is a possibility of the throttle 5 being fully closed, i.e., a state of the vehicle being disable from traveling.

In the conventional throttle control system as described above, malfunctions of each of the accelerator sensors 20 and 21 cannot always be detected under all possible conditions and, moreover, a malfunction of the accelerator switch 22 cannot be detected. It is therefore impossible to maintain a minimum function of operating with safety.

SUMMARY OF THE INVENTION

In view of the above-described problems, an object of the present invention is to provide a throttle control system capable of maintaining a minimum function of traveling with safety by reliably detecting malfunctions of accelerator sensors and an accelerator switch under any condition and by preventing any dangerous situation.

To achieve this object, according to one aspect of the present invention, there is provided a throttle control system comprising a throttle for adjusting the intake air flow into an engine of a motor vehicle, a throttle actuator for driving the throttle by an electrical signal, a throttle sensor for detecting the opening of the throttle, first and second accelerator sensors for detecting the amount of operation of an accelerator and for generating first and second accelerator operation amount signals, an accelerator switch operated in response to a predetermined amount of operation within the range of operation of the accelerator, throttle opening control means for driving and controlling the throttle actuator by a throttle control signal according to a target opening of the throttle, and malfunction detection means for detecting a malfunction of at least one of the first and second accelerator sensors and the accelerator switch on the basis of the first and second accelerator operation amount signals and an output signal from the accelerator switch. The throttle opening control means forms the throttle control signal supplied to the throttle actuator according to the first accelerator operation amount signal when the first and second accelerator sensors are operating normally, and forms the throttle control signal according to the output signal from the accelerator switch if a malfunction of at least one of the first and second accelerator sensors is detected.

In this throttle control system, even if the first or second accelerator sensor malfunctions, a minimum function of driving the vehicle by engine power with safety can be maintained by reliably detecting the malfunctioning state and by changing the control operation to a throttle control based on the output signal from the accelerator switch operating normally.

According to another aspect of the present invention, there is provided a throttle control system which is formed by adding a malfunction alarm means to the throttle control system provided in the first aspect of the invention. The malfunction alarm means is driven by a malfunction detection signal from the malfunction detection means.

In this throttle control system, the malfunction alarm means is driven in response to the malfunction detection signal to inform a vehicle driver of the malfunctioning state of the accelerator switch as well as the accelerator sensors and to urge the driver to change the malfunctioning part or to take other measures.

These and other objects, features and advantages of the present invention will become apparent from the following detailed description of the invention.

DESCRIPTION OF THE PREFERRED EMBODIMENTS

Embodiments of the present invention will be described below with reference to the accompanying drawings.

Embodiment 1

Figure 1:
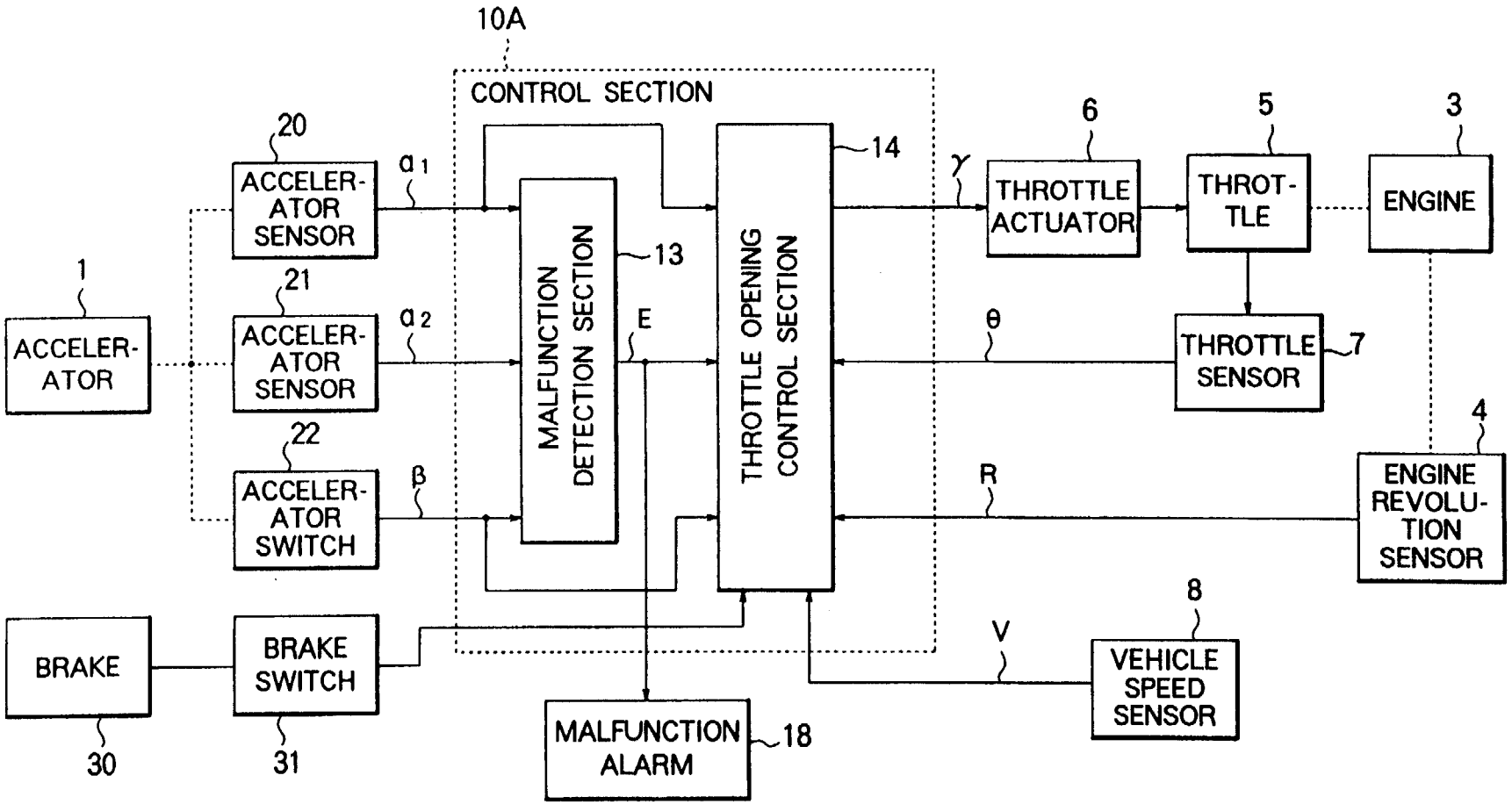
FIG. 1 is a block diagram of a throttle control system in accordance with an embodiment of the present invention.

FIG. 1 is a block diagram of a throttle control system in accordance with an embodiment of the present invention. Components 1, 20 to 22, and 3 to 8 are the same as those in the above-described conventional system.

A unit 10A corresponds to the above-described control unit 10 and is formed of a malfunction detection section (malfunction detection means) 13 which generates a malfunction detection signal E when it detects a malfunction of the accelerator sensor 20 or 21 or the accelerator switch 22, and a throttle opening control section (throttle opening control means) 14 which changes a throttle control signal $\gamma$ according to the malfunction detection signal E.

A malfunction alarm (malfunction alarm means) 18 is provided, which is driven by the malfunction detection signal E.

The malfunction detection section 13 receives acceleration operation amount signals $\alpha_1$ and $\alpha_2$ from the accelerator sensors 20 and 21 and an output signal $\beta$ from the accelerator switch 22 to detect whether the accelerator switch 20 or 21 or the accelerator switch 22 malfunctions.

The throttle opening control section 14 receives the accelerator operation amount signal $\alpha_1$ from the accelerator sensor 20, the output signal $\beta$ from the accelerator switch 22 and the malfunction detection signal E from the malfunction detection means 13, forms the throttle control signal $\gamma$ on the basis of the accelerator operation amount signal $\alpha_1$ in a normal state and forms the throttle control signal $\gamma$ on the basis of the accelerator switch output signal $\beta$ when it receives the malfunction detection signal E designating a malfunction of the accelerator sensor 20 or 21.

In this case, the accelerator operation amount signal $\alpha_1$ from the accelerator sensor 20 relates directly to the throttle control, and the accelerator operation amount signal $\alpha_2$ from the accelerator sensor 21 is used to well as the accelerator switch output signal $\beta$. well as the accelerator switch output signal $\beta$.

Figure 2A:
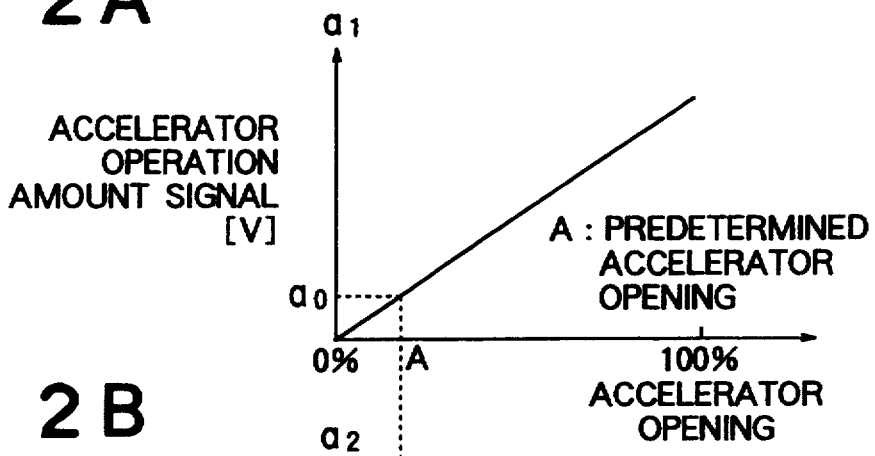
FIGS. 2A to 2C are characteristic diagrams of accelerator operation amount signals and an accelerator switch output signal with respect to the accelerator opening in the control system shown in FIG. 1.
Figure 2B:
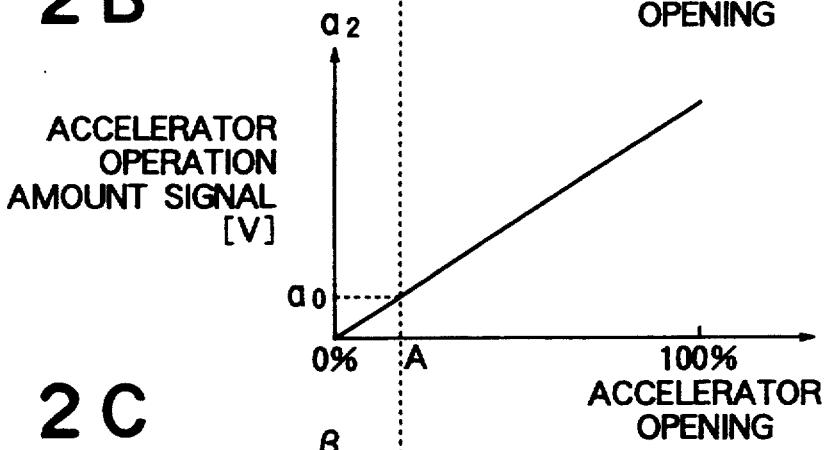
Figure 2C:
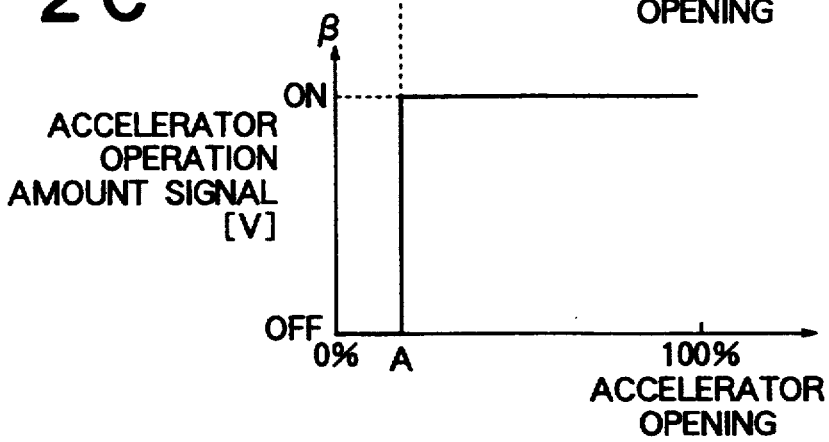

FIGS. 2A to 2C are characteristic diagrams showing the accelerator operation amount signals $\alpha_1$ and $\alpha_2$ and the output signal $\beta$ from the acceleration switch 22 with respect to the actual accelerator opening. Values A and $\alpha_6$ are the same as those mentioned above.

As shown in FIGS. 2A and 2B, the accelerator operation amount signals $\alpha_1$ and $\alpha_2$ are formed of voltage signals of the same characteristic proportional to the accelerator opening. As shown in FIG. 2C, the accelerator switch output signal $\beta$ is formed of a voltage signal which is switched on or off at the predetermined opening A [%]. For example, the predetermined opening A of the accelerator is set to about 5% and the predetermined value $\alpha_9$ of the operation amount signal corresponding to the predetermined opening A is about 1.0 V.

The operation of Embodiment 1 of the present invention shown in FIG. 1 will be described with reference to FIGS. 2A to 2C.

In a state where there is no malfunction, the output from accelerator switch 22 is at an off (low) level when the accelerator opening is not larger than the predetermined opening A, and is increased to an on (high) level when the accelerator opening exceeds the predetermined opening A. Also, the accelerator sensors 20 and 21 generate accelerator operation amount signals $\alpha_1$ and $\alpha_2$ having a value equal to or smaller than the predetermined value $\alpha_0$ when the accelerator opening is equal to or smaller than the predetermined opening, and generate accelerator operation amount signals $\alpha_1$ and $\alpha_2$ having a value larger than the predetermined value $\alpha_0$ when the accelerator opening exceeds the predetermined opening A.

In the normal state, the voltage values of the accelerator operation amount signals $\alpha_1$ and $\alpha_2$ are approximately equal to each other and the difference therebetween is equal to or smaller than a malfunction determination value $\gamma$.

Thus, if all the accelerator sensors 20 and 21 and the accelerator switch 22 are operating normally, the accelerator switch signal $\beta$ is at the on level when the accelerator opening is larger than A %, that is, when the accelerator operation amount signals $\alpha_1$ and $\alpha_2$ are larger than the predetermined value $\alpha_0$, and is at the off level when the accelerator operation amount signals $\alpha_1$ and $\alpha_2$ are smaller than the predetermined value $\alpha_0$.

In this case, no malfunction detection signal E is generated from the malfunction detection section 13, and the throttle opening control section 14 calculates a target opening $\theta_0$ of the throttle 5 according to the accelerator operation amount signal $\alpha_1$ and on the basis of operating conditions (engine revolutions R, vehicle speed V and other factors), and forms the throttle control signal $\gamma$ to the throttle actuator 6 so that the throttle opening $\theta$ detected by the throttle sensor 7 becomes equal to the target opening $\theta_0$.

On the other hand, the malfunction detection section 13 always monitors the accelerator operation amount signals $\alpha_1$ and $\alpha_2$ and the accelerator switch output signal $\beta$, and generates a malfunction detection signal E designating a malfunction of the accelerator sensor 20 or 21 if a voltage difference is caused between the accelerator operation amount signals $\alpha_1$ and $\alpha_2$ by occurrence of the malfunction of the accelerator sensor 20 or 21, and if this voltage difference exceeds the malfunction determination value $\gamma$, which is selected by considering dispersions of voltage and temperature characteristics.

The malfunction detection signal E serves to transmit malfunction occurrence information to the throttle opening control section 14 and to drive the malfunction alarm 18 to inform a vehicle driver of the occurrence of the malfunction of the accelerator sensor 20 or 21.

The malfunction detection section 13 determines that the acceleration switch 22 malfunctions if the accelerator switch output signal $\beta$ is at the off level even though the values of the accelerator operation amount signals $\alpha_1$ and $\alpha_2$ are greater than the predetermined value $\alpha_0$ while the voltage difference therebetween is equal to or smaller than the malfunction determination value $\gamma$. The malfunction detection section 13 then inputs a malfunction detection signal E designating the malfunction of the accelerator switch 22 to the throttle opening control section 14.

The malfunction detection section 13 also determines a malfunction of the acceleration switch 22 and inputs a malfunction detection signal E designating the malfunction of the accelerator switch 22 to the throttle opening control section 14 if, conversely, the accelerator switch output signal $\beta$ is at the on level even though the values of the accelerator operation amount signals $\alpha_1$ and $\alpha_2$ are smaller than the predetermined value $\alpha_0$ while the voltage difference therebetween is equal to or smaller than the malfunction determination value $\gamma$.

Also if a malfunction of the accelerator switch 22 is detected in this manner, the malfunction alarm 18 is driven by the malfunction detection signal E to inform the driver of the occurrence of the malfunction of the accelerator switch 22 and to enable the driver to take necessary measures, e.g., interchanging a part.

The operation of the throttle opening control section 14 will be described in detail with reference to FIGS. 3A and 3B.

As mentioned above, in a state where the accelerator sensors 20 and 21 and the accelerator switch 22 are operating normally, the throttle opening control section 14 calculates the target opening $\theta_0$ according to the voltage value of the accelerator operation amount signal $\alpha_1$ and depending upon the operating conditions, and controls the throttle 5 through the throttle actuator 6 so that the target opening $\theta_0$ is reached while monitoring the throttle opening $\theta$ from the throttle sensor 7.

If in this state the accelerator switch 22 malfunctions and the malfunction detection signal E from the malfunction detection section 13 is input to the throttle opening control means 14, the malfunction alarm 18 is driven but the throttle opening control section 14 controls the opening $\theta$ of the throttle 5 according to the accelerator operation amount signal $\alpha_1$ as in the normal state.

Figure 3A:
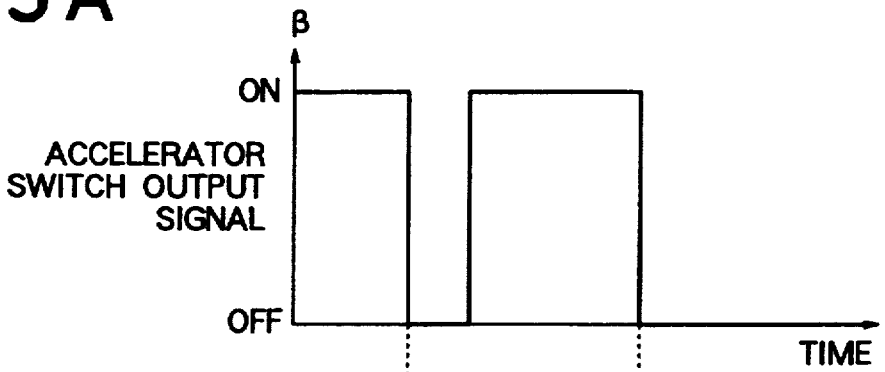
FIGS. 3A to 3B are characteristic diagrams of the operation of controlling the throttle opening when an accelerator sensor malfunctions in the control system shown in FIG. 1.
Figure 3B:
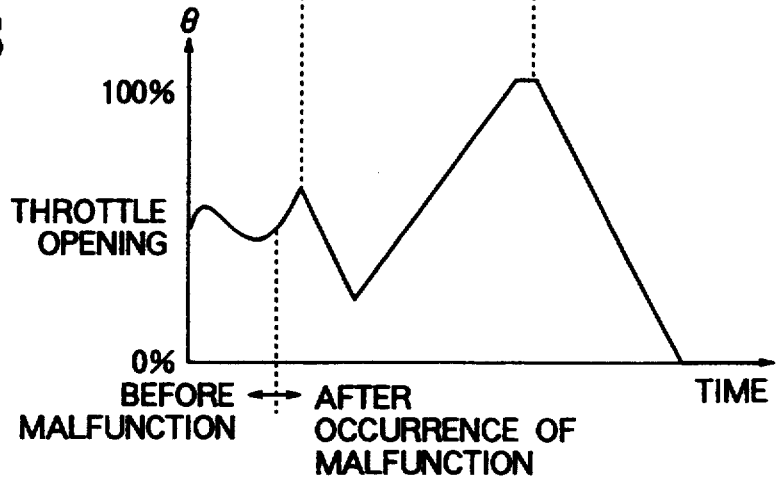

On the other hand, if one of the accelerator sensors 20 and 21 malfunctions and the malfunction detection signal E from the malfunction detection section 13 is input to the throttle opening control means 14, the throttle opening control section 14 changes its operation to start, from the position of the throttle opening $\theta$ immediately before the occurrence of malfunction, a control such as that shown in FIGS. 3A and 3B according to the accelerator switch output signal $\beta$.

That is, it starts controlling the throttle opening $\theta$ in such a manner that, as shown in FIGS. 3A and 3B, when the throttle switch output signal $\beta$ (FIG. 3A) is at the one level, the throttle opening $\theta$ is increased at a predetermined rate from the initial opening, and, when the output signal $\beta$ is at the off level, the throttle opening $\theta$ is reduced at a predetermined rate from the opening corresponding to the time when the output signal $\beta$ is set to the off level.

Thus, the operation of detecting a malfunction of the accelerator sensor 20 or 21 is performed and, if a malfunction occurs, the throttle control method is changed according to the place where the malfunction has occurred to continue the control operation so that the throttle opening $\theta$ is selected only in response to the accelerator switch output signal $\beta$, thereby maintaining a minimum traveling function while avoiding the risk of abrupt increase in vehicle speed.

Also, the driver is informed of the malfunctioning state through the malfunction alarm 18.

Embodiment 2

In Embodiment 1 described above, when a malfunction of the accelerator sensor 20 or 21 occurs, the throttle opening control section 14 starts changing the throttle opening $\theta$ according to the accelerator switch output signal $\beta$ from the throttle 5 opening position immediately before the occurrence of the malfunction. The arrangement may alternatively be such that the throttle opening is changed after it has been controlled so as to be set to a predetermined throttle opening position close to the fully closed position. In this case, the risk of an abrupt increase in vehicle speed is further reduced.

Embodiment 3

Figure 4A:
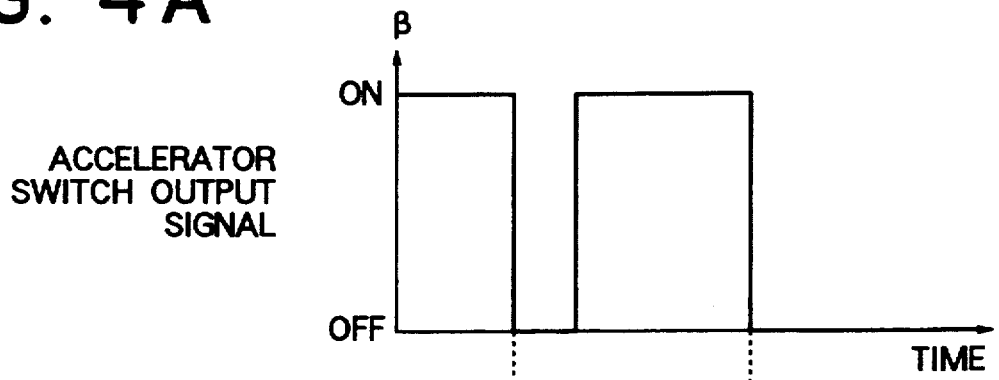
FIGS. 4A to 4B are characteristic diagrams of the operation of controlling the throttle opening when an accelerator sensor malfunctions in accordance with a third embodiment of the present invention.
Figure 4B:
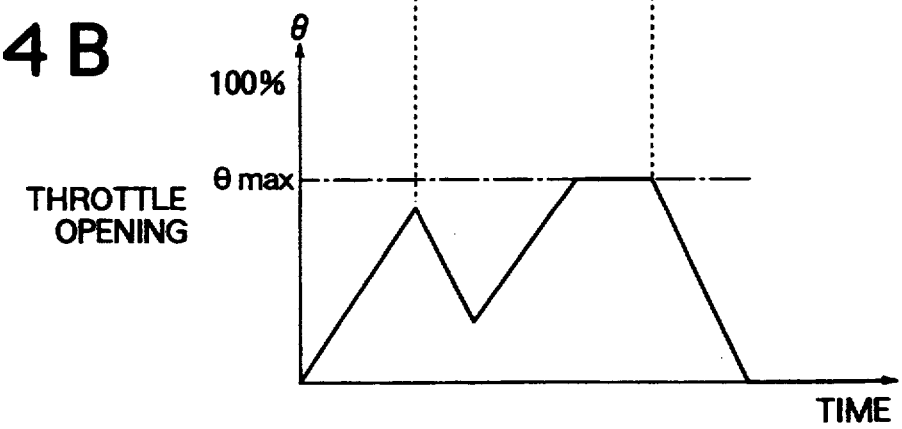
Figure 5:
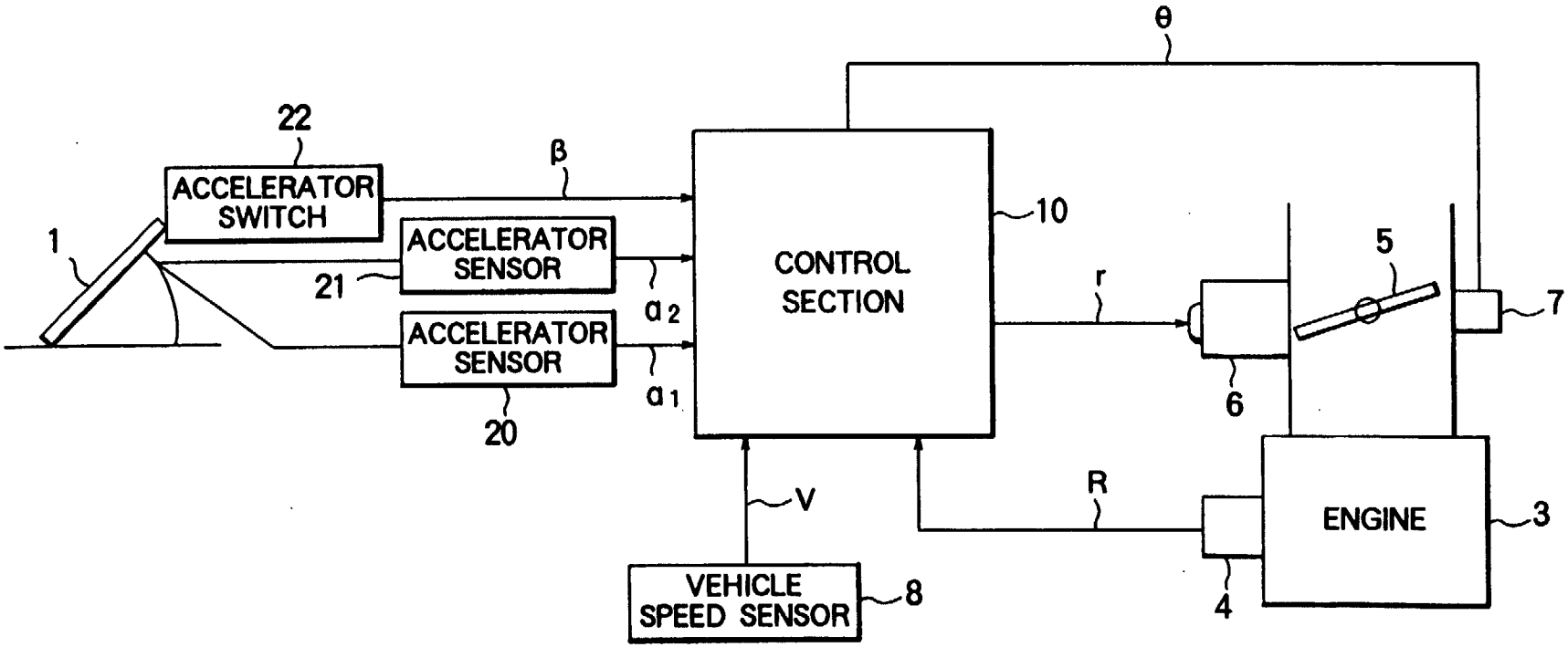
FIG. 5 PRIOR ART
FIG. 5 is a block diagram of the construction of a conventional throttle control system.
Figure 6A:
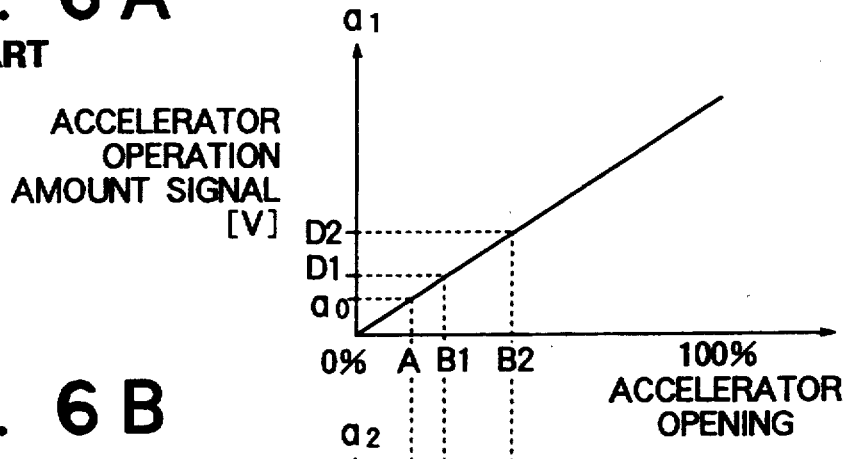
FIG. 6A PRIOR ART
FIG. 6A to 6C are characteristic diagrams of accelerator operation amount signals and an accelerator switch output signal with respect to the accelerator opening, showing a state of the conventional control system in which an accelerator sensor malfunctions.
Figure 6B:
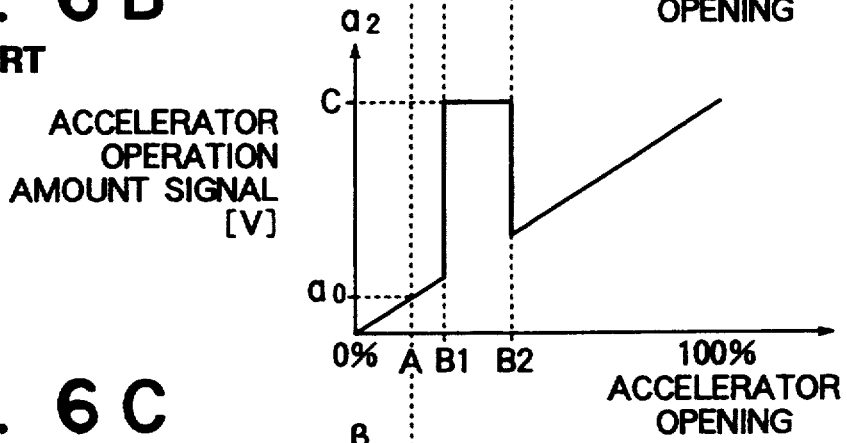
FIG. 6B PRIOR ART
Figure 6C:
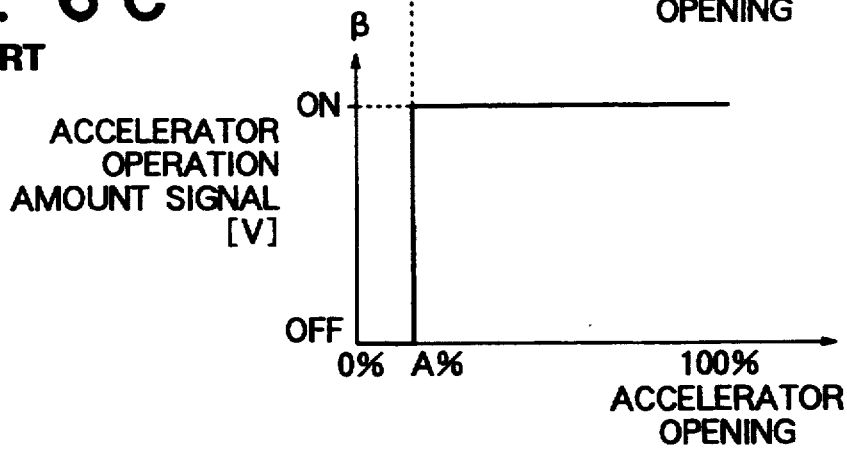
FIG. 6C PRIOR ART

The method of controlling the throttle opening $\theta$ according to the accelerator switch output signal $\beta$ may alternatively be such that a predetermined upper limit $\theta$ max of the throttle opening (e.g., a minimum opening necessary for traveling) is set and the throttle 5 is inhibited from opening above the upper limit $\theta$ max, as shown in FIGS. 4A and **4*b***.

Further, a means for detecting a depressed state of the brake pedal may be provided and another control may be added to set the upper limit $\theta$ max of the throttle opening to a smaller value or to inhibit a control of increasing the opening of the throttle 5 during braking. The risk of an abrupt increase in vehicle speed is further reduced thereby. The braking detection means may be formed of, for example, a brake switch 31 for detecting the operation of the brake pedal, as shown in FIG. 1.

Embodiment 4

When the throttle opening $\theta$ is controlled according to the accelerator switch output signal $\beta$, the throttle opening $\theta$ may be changed at different rates, that is, it may be controlled so as to be increased at a smaller rate and reduced at a higher rate. Alternatively, the throttle opening $\theta$ may be changed at a rate in accordance with a predetermined function. The risk of an abrupt increase in vehicle speed is further reduced thereby.

Embodiment 5

In Embodiment 1, the output characteristics of the accelerator sensors 20 and 21 are equal to each other. However, the accelerator sensor 21 is used only for malfunction detection, and the control is not influenced by a reduction in the accuracy of the accelerator sensor 21 relative to that of the accelerator sensor 20. A low-priced sensor 21, which may be lower in accuracy, may be used as the accelerator sensor 21 to form the system at a lower cost.

As described above, a throttle control system provided in the first aspect of the present invention has a throttle for adjusting the intake air flow into an engine of a motor vehicle, a throttle actuator for driving the throttle by an electrical signal, a throttle sensor for detecting the opening of the throttle, first and second accelerator sensors for detecting the amount of operation of an accelerator and for generating first and second accelerator operation amount signals, an accelerator switch operated in response to a predetermined amount of operation within an accelerator operation range, a throttle opening control means for driving and controlling the throttle actuator by a throttle control signal according to a target opening of the throttle, and malfunction detection means for detecting a malfunction of at least one of the first and second accelerator sensors and the accelerator switch on the basis of the first and second accelerator operation amount signals and an output signal from the accelerator switch. The throttle opening control means forms the throttle control signal supplied to the throttle actuator according to the first accelerator operation amount signal when the first and second accelerator sensors are operating normally, and forms the throttle control signal according to the output signal from the accelerator switch if a malfunction of at least one of the first and second accelerator sensors is detected. Thus, a throttle control system can be provided which can reliably detect a malfunction of the accelerator sensors under any condition to ensure and maintain a minimum function of driving the vehicle by engine power with safety while avoiding occurrence of a situation where the vehicle speed can be abruptly increased or the vehicle cannot run.

In a throttle control system provided in the second aspect of the present invention, a malfunction alarm means which is driven by a malfunction detection signal from the malfunction detection means is provided to inform a vehicle driver of a malfunctioning state and to urge the driver to change the malfunctioning part or to take other measures. Thus, a throttle control system further improved in terms of safety can be obtained.

Throttle control systems improved by further safety means can also be provided in other aspects of the present invention.

What is claimed is:

1. A throttle control system comprising:

a throttle for adjusting the intake air flow into an engine of a motor vehicle;

a throttle actuator for driving said throttle by an electrical signal;

a throttle sensor for detecting the opening of said throttle;

first and second accelerator sensors for detecting the amount of operation of an accelerator and for generating first and second accelerator operation amount signals;

an accelerator switch operated in response to a predetermined amount of operation within the range of operation of said accelerator;

throttle opening control means for driving and controlling said throttle actuator by a throttle control signal according to a target opening of said throttle; and malfunction detection means for detecting a malfunction of at least one of said first and second accelerator sensors and said accelerator switch on the basis of the first and second accelerator operation amount signals and an output signal from said accelerator switch;

wherein said throttle opening control means forms the throttle control signal supplied to said throttle actuator according to the first accelerator operation amount signal when said first and second accelerator sensors are operating normally, and forms the throttle control signal according to the output signal from said accelerator switch if a malfunction of at least one of said first and second accelerator sensors is detected.

2. A throttle control system according to claim 1 wherein said malfunction detection means generates a malfunction detection signal, and alarm means driven by the malfunction detection signal to effect malfunction information is further provided.

3. A throttle control system according to claim 1 wherein if a malfunction of at least one of said first and second accelerator sensors is detected by said malfunction detection means, said throttle opening control means controls said throttle actuator so that the throttle opening is increased at a predetermined rate from the position of a throttle opening immediately before the occurrence of the malfunction when the output signal from the accelerator switch is at an on level, and so that the throttle opening is reduced at a predetermined rate when the output signal is at an off level.

4. A throttle control system according to claim 3 wherein if a malfunction of at least one of said first and second accelerator sensors is detected by said malfunction detection means, said throttle opening control means controls said throttle actuator so that the opening of said throttle is set to a throttle opening position close to a fully closed position.

5. A throttle control system according to claim 3 wherein a predetermined upper limit of the throttle opening is set for the control of changing the throttle opening at the time of occurrence of a malfunction by said throttle opening control means, and said throttle opening control means is arranged to perform the control so that the upper limit is not exceeded.

6. A throttle control system according to claim 5 further comprising a brake switch operated in response to a predetermined amount of operation within the range of operation of a brake pedal, wherein in the control of changing the throttle opening at the time of occurrence of a malfunction by said throttle opening control means, the upper limit of the throttle opening is set to a smaller value during braking.

7. A throttle control system according to claim 5 further comprising a brake switch operated in response to a predetermined amount of operation within the range of operation of a brake pedal, wherein in the control of changing the throttle opening at the time of occurrence of a malfunction by said throttle opening control means, a control as in a direction of increasing the throttle opening is inhibited during braking.

8. A throttle control system according to claim 5 further comprising a brake switch operated in response to a predetermined amount of operation within the range of operation of a brake pedal, wherein in the control of changing the throttle opening at the time of occurrence of a malfunction by said throttle opening control means, said throttle opening control means controls said throttle so that the throttle opening is increased gradually and is reduced rapidly.

* * * * *